United States Patent [19]

Countryman

[11] 3,937,345

[45] Feb. 10, 1976

[54] SHOVEL LOADER WITH EJECTOR BUCKET

[75] Inventor: Donald L. Countryman, Gresham, Oreg.

[73] Assignee: Wagner Mining Equipment, Inc., Portland, Oreg.

[22] Filed: Nov. 15, 1974

[21] Appl. No.: 524,067

[52] U.S. Cl. ..... 214/510; 214/82; 180/79.2 B; 180/44 F

[51] Int. Cl.[2] ..... B60P 1/04

[58] Field of Search ..... 214/82, 510, 146 E, 767, 214/774; 180/51, 79.2 B, 44 F, 66 R

[56] References Cited

UNITED STATES PATENTS

| | | | |
|---|---|---|---|
| 3,545,634 | 12/1970 | Reed | 214/510 |
| 3,648,868 | 3/1972 | Richler | 214/82 X |
| 3,672,520 | 8/1970 | Linville | 214/82 |
| 3,865,208 | 2/1975 | Crawshay et al. | 180/44 F |

*Primary Examiner*—Albert J. Makay

*Attorney, Agent, or Firm*—Lee R. Schermerhorn

[57] ABSTRACT

A loader vehicle has a digging and scooping buchet equipped with a push plate ejector for dumping without tipping the bucket downward. The ejector plate is reciprocated in the bucket by a telescopic cylinder having a piston rod connected to a bracket projecting from the rear side of the bucket. In raising the bucket to dumping position the bracket and cylinder swing down between the wheels in a clear space made available by the absence of the conventional axle and differential. In order to provide this clear space the wheels are driven by individual hydraulic motors.

5 Claims, 3 Drawing Figures

A
B
C
10
11
12
13
14
15
16
17
20
21
25
26
27
28
31
32
33
34
35
36
40
42
43
45
47
50
51
52
53
55
60
61
62
63
65
66
67

SHOVEL LOADER WITH EJECTOR BUCKET

BACKGROUND OF THE INVENTION

This invention relates to a loader vehicle having a digging scooping bucket equipped with a push plate ejector for dumping without tipping the bucket downward.

For work in places with limited overhead clearance as in mines and tunnels it is advantageous to provide the loader bucket with a push plate ejector so that the bucket does not have to be raised to a high level for dumping. There is often insufficient overhead clearance for raising a loader bucket high enough to tip the bucket forward for dumping by gravity into a mine car or truck or onto a conveyor belt or the like.

Push plate ejector buckets heretofor proposed for this purpose have had various objectionable features such as protuberances within the bucket to house hydraulic cylinders, rack and pinion mechanisms which are difficult to shield from the material in the bucket, and obstructions projecting from the front side of the ejector plate which may protrude beyond the lip of the bucket and prevent dumping against a wall or other object.

Objects of the invention are, therefore, to provide an improved ejector bucket, to provide an ejector bucket without protuberances therein containing hydraulic cylinders or other actuating mechanisms, to provide a bucket which does not contain actuating mechanisms that may be impaired by the material in the bucket, to provide a push plate which does not have parts that may project beyond the lip of the bucket, and to provide a bucket having a push plate ejector with an actuating cylinder which swings down between the wheels of the vehicle when the bucket is raised for dumping.

SUMMARY OF THE INVENTION

In the present construction the bucket is left clear and unobstructed by any mechanism for reciprocating the ejector plate. The reciprocatng cylinder extends from the rear side of the bucket. The bucket is not mounted on the conventional boom for raising and lowering to digging, carrying and dumping positions but is pivoted for these movements directly on the frame of the vehicle closely adjacent the bottom rear corner of the bucket.

When the bucket is raised to dumping position the ejector plate cylinder and piston rod unit swing downward in a space between the wheels of the vehicle. Space for this swinging movement is made available by eliminating the usual driving axle and differential between the wheels. Instead, the wheels are driven by individual hydraulic motors which do not extend into the space normally occupied by the axle and differential. Thus, the present form of construction results in a compact and economical arrangement which is well suited for work in mines and tunnels and the like.

The invention will be better understood and additional objects and advantages will become apparent from the following description of the preferred embodiment illustrated in the accompanying drawings. Various changes may be made, however, in the details of construction and arrangement of parts and certain features may be used without others. All such modifications within the scope of the appended claims are included in the invention.

DESCRIPTION OF THE PREFERRED EMBODIMENT

Figures 1, 3:
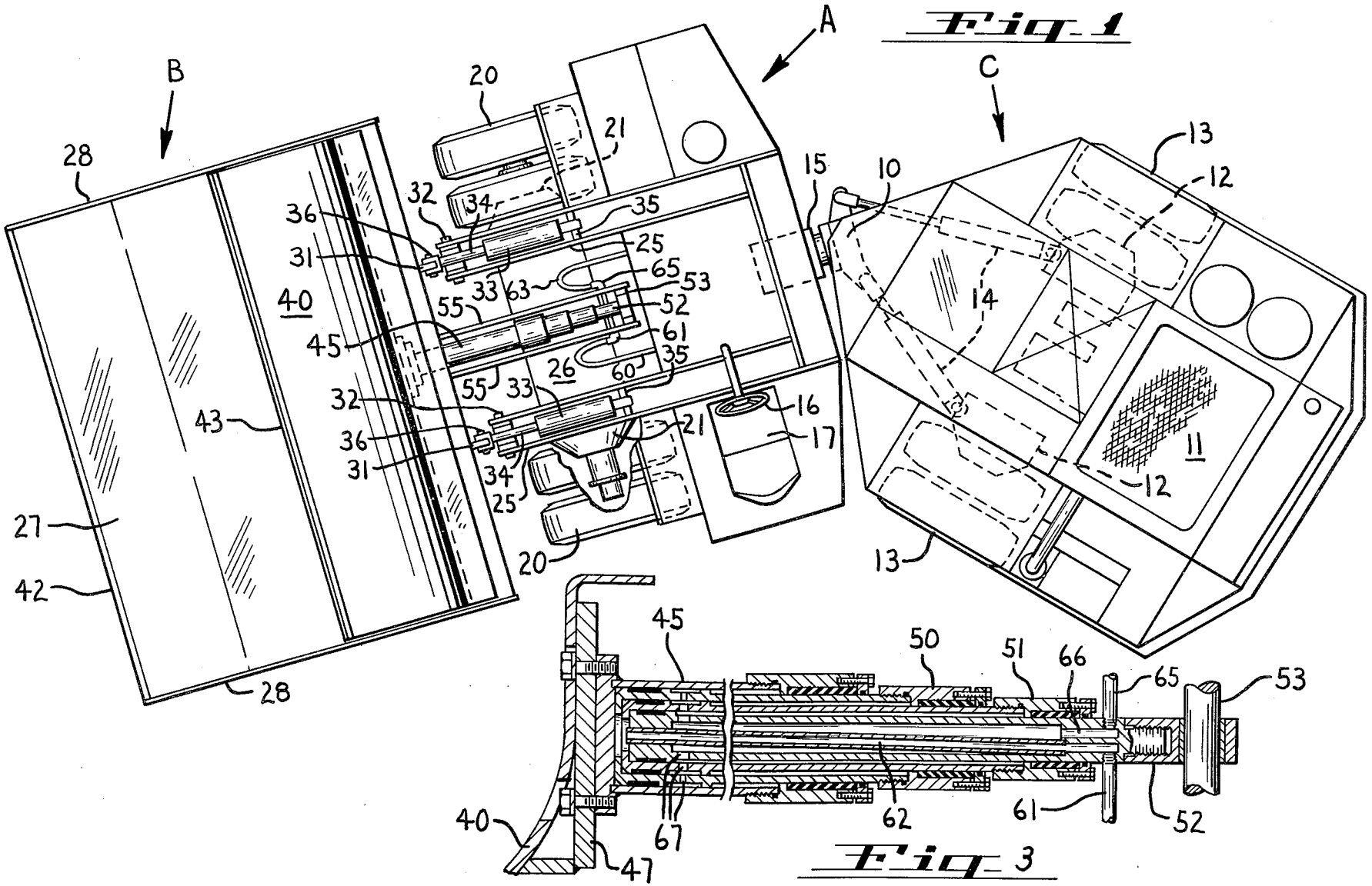
FIG. 1 is a top plan view, with parts broken away, showing a loader vehicle embodying the invention.
FIG. 3 is a longitudinal sectional view of the telescopic cylinder for the ejector plate with the center portion broken away, the left end being shown in vertical section and the right end being shown in horizontal section.

The present vehicle is preferably of the articulated type having a vertical steering pivot 10 connecting two body sections A and C. Body section C contains an internal combustion engine at 11 which operates a hydraulic pump for driving individual hydraulic motors 12, 12 for the wheels 13, 13. The vehicle is steered by a pair of hydraulic cylinder and piston units 14 which can swing the body sections A and C relative to each other, as shown in FIG. 1, for turning.

Steering pivot 10 is incorporated in a swivel connection 15 which allows body section C to rotate on the longitudinal axis of body section A for travel on an uneven ground surface. Swivel connection 15 contains motor and steering controls and hydraulic lines from the engine driven pump, which pass between sections C and A. The steering controls are actuated by steering wheel 16 at an operator's station 17 in section A as are various other controls which must be convenient to the operator.

Body section A is supported on wheels 20, 20 driven by individual hydraulic motors 21, 21, leaving an open space between these wheels by the absence of the usual drive shaft and differential. Body section A carries the bucket B.

Figure 2:
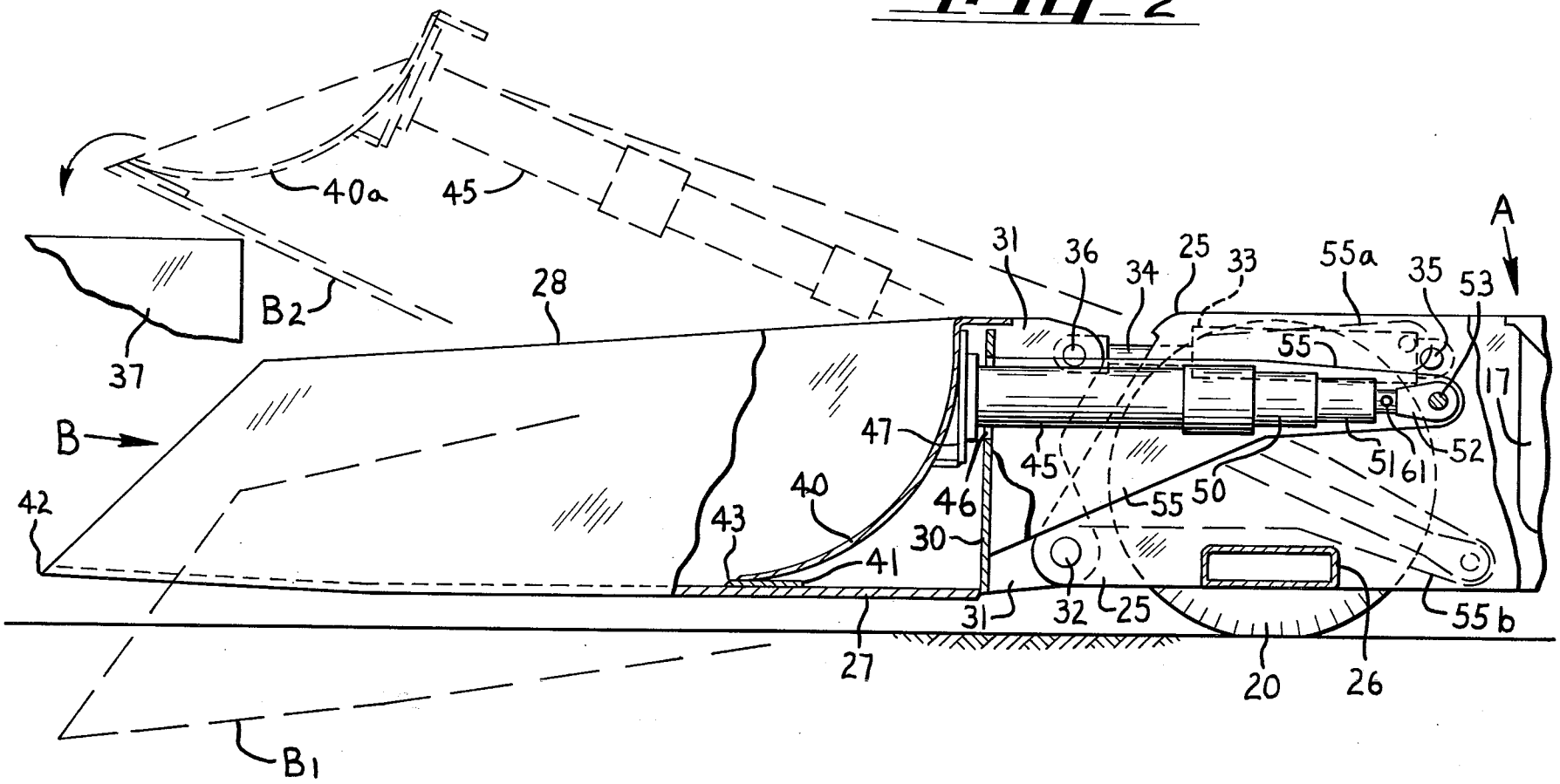
FIG. 2 is a fragmentary longitudinal sectional view, with parts broken away, showing the bucket and ejector plate.

Referring now to FIG. 2, body section A has a pair of longitudinal frame members 25 on opposite sides of the vehicle, wheels 20 and hydraulic motors 21 being mounted on these frame members. Longitudinal frame members 25 are interconnected by a transverse frame member 26.

Bucket B has a bottom wall 27, a pair of flat side walls 28 and a rear wall 30. A pair of vertical brackets 31 on rear wall 30 pivot the bucket on longitudinal frame members 25 by means of horizontal pivot pins 32 adjacent the bottom of the bucket. Bottom wall 27 is flat in a transverse direction and slightly curved in a longitudinal direction so that the front end portion of the bottom wall will lie flat on the ground in scooping position.

The bucket may be tilted up or down by a pair of hydraulic cylinders 33 having piston rods 34. Cylinders 33 are pivotally connected to frame members 25 by horizontal pins 35 and piston rods 34 are pivotally connected to upper portions of brackets 31 adjacent the top of the bucket by horizontal pins 36. Bucket B is shown in carrying position in solid lines. The broken line position at $B^1$ is the digging position and the broken line positin at $B^2$ is the dumping position, as for example to dump into a mine car or truck 37.

The load may be discharged in any position of the bucket by reciprocating the ejector push plate 40 in the bucket. Push plate 40 extends the width of the bucket between its side walls 28 and is equipped on its lower edge with a shoe 41 which sides on bottom wall 27. The ejector plate 40 is shown fully retracted in solid lines and fully extended at 40*a* in broken lines. In fully extended position, the lower edge 43 of the ejector plate is flush with the lip 42 of the bucket.

Ejector plate 40 is reciprocated by a telescopic hydraulic cylinder 45. Cylinder 45 extends through an opening 46 in the back wall 30 of the bucket and the forward end of the cylinder is connected to a bracket 47 on the back of the ejector plate.

Telescopic cylinder 45 contains a pair of smaller cylinders 50 and 51 which slide within the outer cylinder and piston rod 52 extends from the rearmost cylinder 51. Piston rod 52 is connected to a pin 53 in the rearward end of a rearwardly extending stirrup bracket 55 mounted on the back wall 30 of the bucket. Stirrup bracket 55 comprises a pair of vertical plates on opposite sides of cylinder 45 which are interconnected at their rearward ends by pin 53 to form a U-shaped member in the general configuration of a stirrup which is stressed in tension when piston rod 52 is extended to slide ejector plate 40 forward and discharge a load from the bucket.

The piston rod is extended by introducing hydraulic pressure through hose loop 60 in FIG. 1 to pipe connection 61 in piston rod 52 which communicates through tube 62 with the head end of the cylinder. The piston rod and ejector plate are retracted by introducing hydraulic pressure through hose loop 63 to pipe connection 65 which communicates through bore 66 with the rod end of cylinder 51. Intercommunication between the cylinders 45, 50, and 51 is established through rod and cylinder ports 67. Pipe connections 61 and 65 project laterally through openings in the side plates of stirrup bracket 55.

The geometry of the bucket linkage is such that when the bucket is lowered to its B1 position stirrup bracket 55 swings up to the broken line position at 55*a* in FIG. 2. When the bucket is raised to its B2 position stirrup bracket 55 swings down to its broken line position at 55*b*. In the latter position bracket 55 maintains adequate ground clearance but it passes between the wheels 20 in the space that would normally be occupied by the conventional axle and differential in a four wheel drive vehicle.

In the present vehicle the individual hydraulic motors 12, 12, 21, 21 for each wheel provide the benefit of four wheel drive without having an axle and differential that would interfere with the movements of stirrup bracket 55 when the bucket is raised. At the same time, the conventional bucket boom is eliminated whereby the overall construction is considerably simplified while still achieving advantages not possible in the conventional form of construction.

Having now described my invention and in what manner the same may be used, what I claim as new and desire to protect by Letters Patent is:

1. A shovel loader comprising a vehicle frame supported by wheels on its opposite sides, drive means for said wheels providing an open space between said wheels free of an interconnecting axle, a loader bucket in front of said wheels having bottom, side and back walls and a scooping lip on the front end of said bottom wall, hinge pins pivotally mounting said bucket on said frame adjacent the lower portion of said back wall at the back end of said bottom wall, hydraulic cylinder and piston means connected between said frame and the upper portion of said back wall for pivoting said bucket to move said scooping lip between a depressed digging position and an elevated dumping position, said bottom wall being inclined upward toward its front end in said dumping position, a transverse ejector plate in said bucket, a stirrup bracket extending rearward from said back wall and hinge pins into said open space between said wheels, a hydraulic cylinder mounted on the rear side of said ejector plate and extending through an opening in said back wall, and a piston rod in said cylinder connected to a pin in the rear end of said stirrup bracket for reciprocating said ejector plate in said bucket, said stirrup bracket and piston rod swinging down between lower portions of said wheels in said elevated position of said bucket. .

2. A shovel loader as defined in claim 1, said stirrup bracket comprising a pair of vertical plates on opposite sides of said last cylinder and piston rod.

3. A shovel loader as defined in claim 1 including a pair of hydraulic connections in said piston rod communicating with opposite ends of said last cylinder.

4. A shovel loader as defined in claim 1, said drive means comprising individual hydraulic motors for said wheels.

5. A shovel loader as defined in claim 4 comprising an articulated vehicle having a body section carrying an engine, said body section being connected to said vehicle frame by a vertical steering pivot, a pair of wheels supporting said body section, and drive means comprising individual hydraulic motors for said pair of wheels, to provide four wheel drive for said loader.

* * * * *